US007359487B1

(12) United States Patent
Newcome

(10) Patent No.: US 7,359,487 B1
(45) Date of Patent: Apr. 15, 2008

(54) DIAMOND ANODE

(75) Inventor: Bruce Newcome, Sunnyvale, CA (US)

(73) Assignee: ReVera Incorporated, Sunnyvale, CA (US)

( * ) Notice: Subject to any disclaimer, the term of this patent is extended or adjusted under 35 U.S.C. 154(b) by 263 days.

(21) Appl. No.: 11/228,685

(22) Filed: Sep. 15, 2005

(51) Int. Cl.
*H01J 35/08* (2006.01)

(52) U.S. Cl. ..... 378/143; 378/119

(58) Field of Classification Search ..... 378/119, 378/143

See application file for complete search history.

(56) References Cited

U.S. PATENT DOCUMENTS 4,972,449 A * 11/1990 Upadhya et al. ..... 378/144
5,148,462 A * 9/1992 Spitsyn et al. ..... 378/143
5,804,321 A * 9/1998 Thorpe et al. ..... 428/623
6,489,616 B2 * 12/2002 Giedd ..... 250/338.1
6,591,898 B1 * 7/2003 Chu et al. ..... 165/80.4
6,914,025 B2 * 7/2005 Ekstrom et al. ..... 501/90

* cited by examiner

*Primary Examiner*—Jurie Yun
(74) *Attorney, Agent, or Firm*—Blakely Sokoloff Taylor & Zafman LLP

(57) ABSTRACT

According to one aspect of the invention a robust anode structure and methods of making and using said structure to produce ionizing radiation are disclosed. An ionizing radiation producing layer is bonded to the target side of a highly conductive diamond substrate, by a metal carbide layer. The metal carbide layers improves the strength and durability of the bond, thus improving heat removal from the anode surface and reducing the risk of delaminating the ionizing radiation producing layer, thus reducing degradation and extending the anode's life. A smoothing dopant is alloyed into the radiation producing layer to facilitate keeping the layer surface smooth, thus improving the quality of the x-ray beam emitted from the anode. In an embodiment, the heat sink comprises a metal carbide skeleton cemented diamond material. In another embodiment, the heat sink is bonded to the diamond substrate structure in a high temperature reactive brazing process.

52 Claims, 6 Drawing Sheets

DIAMOND ANODE

BACKGROUND OF THE INVENTION

1). Field of the Invention

This invention relates to the generation of ionizing radiation, such as x-ray, gamma rays, and ultraviolet light. The invention particularly relates to an anode assembly for generating such ionizing radiation and to instruments incorporating such an anode assembly.

2). Discussion of Related Art

A variety of electron microscopes and surface analyzers have evolved recently. One approach to chemometric surface analysis is electron spectroscopy for chemical analysis (ESCA), also known as x-ray photoelectron spectrometry (XPS). Instruments, such as XPS, involve irradiating a sample surface with x-rays and detecting the photoelectrons emitted, which are characteristic of the chemical elements in the surface of the sample. Impinging accelerated electrons onto the surface of an anode is a means of generating such x-rays for such an XPS instrument.

It is desirable to generate an intense x-ray beam for use in an instrument, such as an XPS, to provide better sample throughput and signal processing. Greater x-ray beam intensities generate greater heating of the anode. Recent developments in anode design and structure to better dissipate and remove heat from the anode is disclosed in U.S. Pat. No. 5,315,113 (Larson).

Larson discloses a metal anode mounted on a highly conductive diamond member, with a support block having a channel therein receptive of a fluid coolant. Under the conditions of intense heating and bombardment by energetic electrons, the metal anode often degrades quickly and often delaminates from the diamond member. There is a need to provide an anode having a metal anode strongly bonded to the diamond member, so that the anode structure can withstand higher beam intensities and energies. Anodes typically have very short lifetimes within such instruments, thus it would be desirable to provide a more robust anode with a longer lifetime.

SUMMARY OF THE INVENTION

The present invention is related to robust anode structures and methods of making and using said structures to produce ionizing radiation. In an embodiment, an ionizing radiation producing layer is bonded to the target side of a diamond substrate, having a high thermal conductivity, by a metal carbide layer between the diamond substrate and the ionizing radiation producing layer. The metal carbide layer improves the strength and durability of the bond, thus improving heat removal from the anode surface and reducing the risk of delaminating the ionizing radiation producing layer and thus reducing the degradation of the anode, and thus extending the anode's life.

In an embodiment, a metal carbide layer is formed on the backside of the diamond substrate to improve the bond strength and durability between the diamond substrate and the heat sink of the anode. The improved bonding facilitates the removal of heat from the target side of the anode.

In other embodiments, a metal carbide layer is formed by depositing a metal carbide-forming buffer layer and then annealed to diffuse the metal into the diamond substrate and thus forming a metal carbide layer. The anneal can be a vacuum anneal and/or a laser anneal.

An alternative embodiment of forming a metal carbide layer comprises depositing a metal carbide layer by a chemical vapor deposition (CVD) process, and then annealing.

Another alternative embodiment of forming a metal carbide layer comprises ion implanting a carbide-forming metal into the diamond substrate, and then annealing.

In an embodiment, channels are formed in the heat sink to permit the use of cooling fluids to further remove heat from the anode. In an embodiment, conductive foam can also be placed within the channels to further facilitate heat removal.

In an embodiment, a smoothing dopant is alloyed into the radiation producing layer to facilitate keeping the layer surface smooth after electron beam irradiation, thus improving the quality of the x-ray beam emitted from the anode.

In an embodiment, a heat sink is soldered to a diamond substrate structure by placing a foil of solder between the heat sink and the diamond substrate structure, to form a solder sandwich, and then heating the solder sandwich either under vacuum or in forming gas, thus preventing the oxidation of the anode surface.

In an embodiment, the heat sink comprises a metal carbide skeleton cemented diamond material. In another embodiment, the heat sink comprises a silicon carbide diamond material.

Another embodiment of a process of bonding the heat sink, such as a heat sink comprising silicon carbide skeleton cemented diamond, to the diamond substrate structure comprises a high temperature reactive brazing process, wherein a metal carbide layer is formed during the high temperature reactive brazing process. In an embodiment, the ionizing radiation producing layer is formed after the high temperature reactive brazing process, so as to prevent damage to the ionizing radiation producing layer.

BRIEF DESCRIPTION OF THE DRAWINGS

The invention is described by way of example with reference to the accompanying drawings, wherein.

DETAILED DESCRIPTION OF THE INVENTION

In the following description, various aspects of the present invention will be described, and various details set forth in order to provide a thorough understanding of the present invention. However, it would be apparent to those skilled in the art that the present invention may be practiced with only some or all of the aspects of the present invention, and the present invention may be practiced without the specific details. In other instances, well-known features are admitted or simplified in order not to obscure the present invention.

Figure 1A:
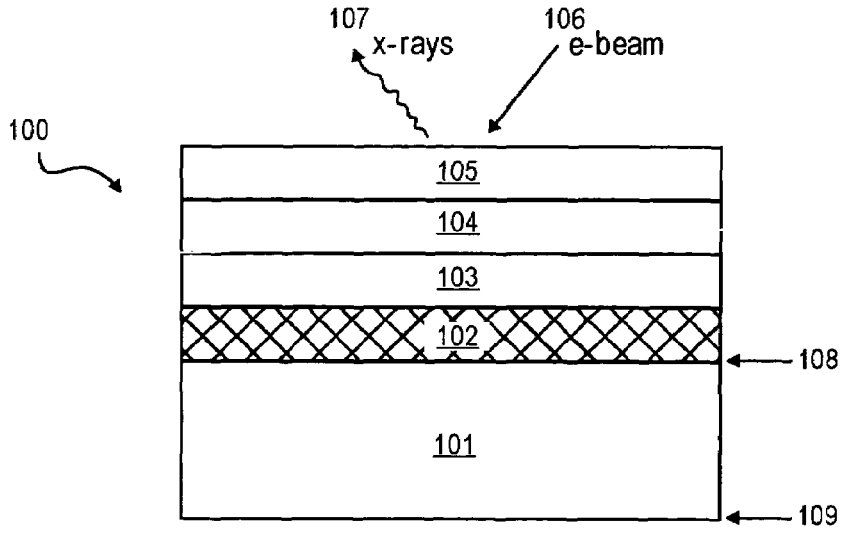
FIGS. 1A to 1B illustrate cross-sectional views of anode structures.

FIG. 1A illustrates a cross-sectional view of the target side 100 of an embodiment of the anode of the present invention. In an embodiment of the invention, an electron beam 106 irradiates a radiation producing layer 105 of the anode to produce an x-ray beam 107, which is then used in an instrument.

Embodiments of the invention may include the use of other sources of energetic particle, other than an electron beam 106. Other sources of energetic particles may include, but are not limited to, ion beams, such as from hydrogen. Embodiments include the production of any ionizing radiation from an ionizing radiation producing layer 106. Ionizing radiation includes any radiation that is energetic enough to break chemical bonds and/or form ions, and includes ultraviolet light, x-rays, and gamma rays.

The electron beam must have sufficient energy to ionize atoms in the radiation producing layer 105 in order for the ionized atom's electrons to return to some lower energy level and thus emit radiation, such as x-rays. Heat is generated from the energetic electrons impinging onto the anode, particularly the radiation producing layer 105. In some applications, the heat generated is sufficient to melt or vaporize the radiation producing layer 105. In order to remove sufficient heat from the radiation producing layer 105 and prevent catastrophic failure of the anode, a diamond substrate 101 having a target side 108 and a backside 109, and having a high thermal conductivity, generally higher than that of aluminum, is bonded to the radiation producing layer 105.

In an embodiment, the ionizing radiation producing layer 106 can be any solid material that is conductive, both thermally and electrically, so as to remove heat and electrical charge build up generated by the electron beam, respectively. In an embodiment, the ionizing radiation comprises x-rays, which are formed from the energetic electron bombardment of an x-ray producing layer 105. In an embodiment, the x-ray producing layer material may be selected from the group consisting of aluminum, magnesium, tungsten, and any combination thereof.

In an embodiment, direct bonding of a radiation producing layer 105 to the diamond substrate 101, may be problematic due to issues related to differences in the materials' coefficient of thermal expansion, and other material properties related to adhesion and bonding compatibility. In an embodiment, a metal carbide layer 102 may be formed to provide a graded transition from a pure carbon diamond crystalline structure to a metal carbide layer to a pure metal layer. The metal carbide layer 102 facilitates a transition between the two dissimilar materials, for example a carbon based material and a metal based material, wherein the carbon component of the carbide, bonds better with the carbon based material, and the metal component of the carbide, bonds better with the metal material, thus greatly improving the bonding between the two materials. In an embodiment of the invention, the metal carbide layer 102 is defined to include material layers containing over about 20 wt. % metal carbide composition. In an embodiment, the metal carbide layer 102 comprises a gradient of carbides.

Embodiments include a metal carbide layer 102 that may comprise a material selected from the group consisting of chromium carbide, titanium carbide, iron carbide, silicon carbide, germanium carbide, gold carbide, boron carbide, iridium carbide, lanthanum carbide, lithium carbide, manganese carbide, molybdenum carbide, osmium carbide, rhenium carbide, rhodium carbide, ruthenium carbide, thorium carbide, uranium carbide, vanadium carbide, tungsten carbide, and any combination thereof. Some embodiments form metal carbides comprising chromium carbide, or titanium carbide, or any combination thereof. It is further anticipated that any type of metal carbide materials could be selected under the condition that its material properties were compatible with those material properties of subsequent layers bonding to said metal carbide layer 102.

In an embodiment, the materials selected for the radiation producing layer 105 are typically designed for the production of specific x-ray emission spectrum and not for compatibility with diamond substrates 101 or other materials. In an embodiment, one or more additional buffer layers may be provided between the metal carbide layer 102 and the radiation producing layer 105, to provide better material compatibility and improve the robustness of the anode.

In an embodiment, the buffer layers 103, 104 may comprise metal carbide forming materials. In an embodiment, the carbide forming materials may comprise chromium, or titanium, or iron, or silicon, or germanium, or gold, or boron, or iridium, or lanthanum, or lithium, or manganese, or molybdenum, or osmium, or rhenium, or rhodium, or ruthenium, or thorium, or uranium, or vanadium, or tungsten, or any combination thereof.

In one embodiment of the invention, a metal carbide forming buffer layer 103 may be provided between the metal carbide layer 102 and the radiation producing layer 105, wherein the metal carbide forming buffer layer 103 comprises a metal carbide forming material. The metal carbide forming material provides for a superior bond to the metal carbide layer 102 primarily due to the compatibility of the materials and the ability of the buffer metal to form carbides at or near the interface between the layers.

In an embodiment, a second buffer layer 104 may be formed on the metal carbide forming buffer layer 103, or alternatively directly on the carbide layer 102. The second buffer layer 104 generally provides for better material compatibility with the radiation producing layer 105, than either the metal carbide forming buffer layer 103 or the metal carbide layer 102. Generally, buffer layers serve as transition materials between the material bonding properties of the radiation producing layer 105 and the metal carbide layer 102. In various embodiments, the anode can contain as many, or as few, buffer layers as needed to provide the bonding strength desired between the radiation producing layer 105 and the metal carbide layer 102, wherein the desired bond strength is sufficient to prevent or reduce the risk of delamination of the radiation producing layer 105 during the use of the anode. In some embodiments, the number of buffer layers can be zero, one, or more layers, wherein each buffer layer thickness may be less than about 400 nm. In an embodiment, each buffer layer thickness may be between about 30 nm. and about 200 nm.

In some embodiments, the metal carbide layer 102, may have a high thermal resistance. In some embodiments, the metal carbide layer 102 should be to be thick enough to inhibit the radiation producing layer 105, and any underlying buffer layers, from delaminating, but not so thick as to unduly increase the thermal resistance to the diamond substrate. If the thermal resistance is too high, then the heat will build up and melt or vaporize the radiation producing layer and/or cause it to delaminate. In an embodiment, the thickness of the metal carbide layer 102 may be between about 2 nm. and about 200 nm. In an embodiment, the thickness of the metal carbide layer 102 may be between about 10 nm. and about 50 nm.

An embodiment of the invention further comprises a surface smoothing dopant alloyed into the radiation producing layer 105. In one embodiment, the surface smoothing dopant may be selected from the group consisting of copper, tungsten, titanium, nickel, gold, chromium, and any combination thereof. By way of example, one embodiment has the radiation producing layer 105 comprising aluminum and the surface smoothing dopant comprising copper. The surface smoothing material [Cu] resides in the grain boundaries of the radiation producing layer 105, thus helping to strengthen and bind the [Al] grains together, thus strengthening the material in the layer. The copper in the grain boundaries of the aluminum grains generates resistance to the electron or ionic bombardment of the layer, and thus helps reduce surface roughness. It is undesirable for the surface of the radiation producing layer to be rough. A rough surface has the effect of reabsorbing the x-rays, thus reducing the intensity of the useable x-rays generated by the anode.

In an embodiment, the concentration of the surface smoothing dopant may be sufficiently high enough to inhibit surface roughening, but without substantially reducing the intensity of the ionizing radiation emitted from the anode when irradiated with energized electrons. For example, in some embodiments, as the concentration of dopant increases, there may be less aluminum atoms and more copper atoms being irradiated, thus the desired K-alpha x-ray line emissions from aluminum may be proportionately reduced. In addition, excess dopant may increase undesirable emissions from the dopant metal, that could significantly interfere with the performance of the equipment having such an anode. In an embodiment, the concentration of the surface smoothing dopant may be between about 10 wt. % and about 0.01 wt. %. In one embodiment, the concentration of the surface smoothing dopant may be between about 0.2 wt. % and about 1.0 wt. %.

Figure 1B:
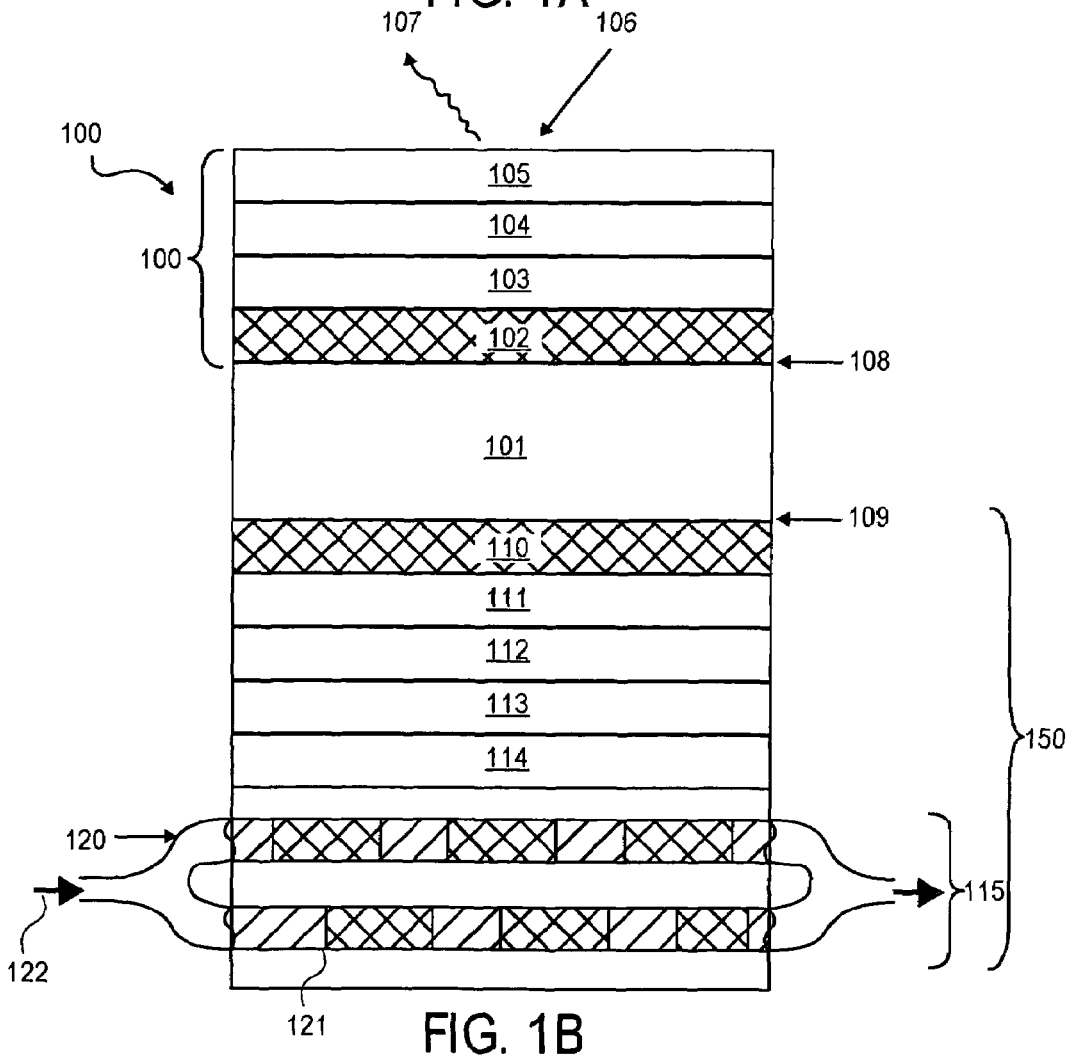

FIG. 1B illustrates a cross-sectional view of both the target side 100 and backside 150 of an embodiment of the anode of the present invention. In an embodiment of the invention, a heat sink 115 is bonded to the backside of the diamond substrate 109. Other embodiments provide various means for bonding the heat sink 115 to the backside of the diamond substrate 109. Such embodiments further comprise forming a backside metal carbide layer 110 on the backside of the diamond substrate 109. Other embodiments comprise forming one or more backside layers 111, 112, and 113 between the backside metal carbide layer 110 and the heat sink 115, wherein, the backside metal carbide layer 110 bonds to the diamond substrate 101 and to the backside layer 111, which is attached to the heat sink 115.

Other embodiments include an anode wherein the backside carbide layer 110 comprises chromium carbide, or nickel carbide, or titanium carbide, or iron carbide, or silicon carbide, or germanium carbide, gold carbide, boron carbide, iridium carbide, lanthanum carbide, lithium carbide, manganese carbide, molybdenum carbide, osmium carbide, rhenium carbide, rhodium carbide, ruthenium carbide, thorium carbide, uranium carbide, vanadium carbide, tungsten carbide, or any combination thereof. In an embodiment, the materials for the backside carbide layer 110 comprise chromium carbide, or nickel carbide, or any combination thereof. In one embodiment, the backside carbide layer 110 comprises a gradient of carbides, wherein the gradient constitutes a gradual change in the concentration of carbides at different depths in the backside carbide layer 110.

In an embodiment, the backside carbide layer 110 is thick enough to inhibit delamination of the diamond substrate 101 from the heat sink 115, but not so thick as to unduly increase the thermal resistance between the diamond substrate 101 and the heat sink 115. If thermal resistance is too high, then not enough heat will be removed from the anode causing damage, such as delamination of the x-ray producing layer 105 from the diamond substrate 101. In an embodiment, the boundaries of the backside metal carbide layer 110 are defined to include over about 20 wt. % carbide composition. In one embodiment, the thickness of the backside carbide layer 110 may be between about 2 nm. and about 200 nm. In an embodiment, the backside carbide layer 110 may be between about 10 nm. and about 50 nm.

Another embodiment comprises one or more backside layers 111, 112, and 113 between the backside metal carbide layer 110 and the heat sink 115, wherein, the backside metal carbide layer 110 bonds to the diamond substrate 101 and to the backside layer 111, which is attached to the heat sink 115. In an embodiment, the one or more backside layers 111, 112, and 113 are selected from the group consisting of titanium, chromium, nickel, gold, silver, aluminum, copper, any alloy thereof, and any combination thereof. In an embodiment, the one or more backside layers 111, 112, and 113 comprise any combination of materials and layers having a high thermal conductivity and where each layer possesses the material properties to bond well with both its adjacent layers. Such an anode results in a progression of well bonding, compatible materials starting from the backside carbide layer 110 and ending in the heat sink 115.

An embodiment comprises a first backside layer 111, comprising chromium, bonded to the backside carbide layer 110, having a thickness of less than about 1.0 micron, and in one embodiment, about 50 nm., a second backside layer 112, comprising nickel, bonded to the first backside chromium layer 111, having a thickness between about 2 microns and about 50 nm., and in one embodiment, about 500 nm., a third backside layer 113, comprising gold, bonded to the second backside nickel layer 112, having a thickness between about 1 micron and about 10 nm., and in one embodiment, about 100 nm.

In an embodiment of the invention, the means for bonding the heat sink 115 to the anode structure further comprises a solder layer 114 between the last layer formed and the heat sink 115. The last layer formed could be the backside metal carbide layer 110, or any of the other backside layers 111, 112, and 113. The last layer formed is that layer which is exposed on the backside of the anode structure prior to attaching the heat sink 115.

In an embodiment, the solder layer 114 comprises a low melting point temperature material that when heated to soldering temperatures would not cause undue oxidation of the ionizing radiation forming layer 105. In one embodiment, the low melting point temperature material has a working soldering temperature of less than or about 280° C. In an embodiment, the solder layer 114 may be selected from the group consisting of an alloy of gold and tin, an alloy of silver and tin, an alloy of lead and tin, an alloy of silver and lead, and any combination thereof. In an embodiment, the solder layer comprises an alloy of gold and tin, and in one embodiment, contains approximately 10% to 30% tin and approximately 90% to 70% gold. In an embodiment, the solder layer comprises an alloy having concentrations approximately corresponding to a eutectic melting point. In an embodiment, an alloy of approximately 80% gold and approximately 20% tin concentrations corresponds approximately to the eutectic melting point of a gold/tin alloy.

In an embodiment, the heat sink 115 is comprised of a high thermal conductivity material. In an embodiment, the high conductivity material comprises copper, silver, or aluminum, or any combination thereof. In an embodiment, the heat sink 115 comprises one or more channels 120 within the body of the heat sink 115, in which cooling fluids can flow through the channels 120 and remove heat from the heat sink 115. In an embodiment, the number of channels and the size of the channels are optimized to increase the total surface area of the channels while maintaining high flow rates of the cooling fluid, so as to maximize removal of heat from the heat sink and anode.

An embodiment of the invention, further comprises a thermally conductive foam 121 within the channels 120 to further increase the total effective surface area of the channels without significantly reducing the flow rate of the cooling fluid. Excessive foam in the channel would substantially reduce flow rate, and thus, may reduce the rate of heat removal.

Figure 2A:
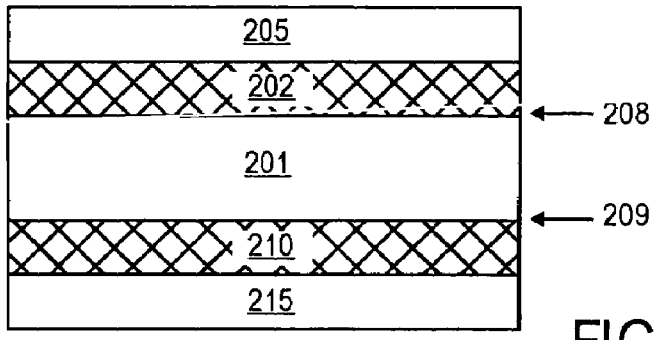
FIGS. 2A to 2G illustrate cross-sectional views of the anode structure at various stages of various embodiments of the method of making the anodes.

Various embodiments of the invention involve various methods of making an anode for generating radiation. FIG. 2A discloses one embodiment of the invention comprising the steps of obtaining a diamond substrate 201, having a high thermal conductivity, and having a target side 208 and a backside 209, opposite the target side 208 of the diamond substrate 201; forming a target side metal carbide layer 202 on the target side 208 of the diamond substrate 201; and then forming a radiation producing layer 205 over the carbide layer 202. Another embodiment further comprises forming a backside metal carbide layer 210 on the backside 209 of the diamond substrate 201; and then bonding a heat sink 215 over the backside metal carbide layer 210.

Various methods of forming a metal carbide layer are anticipated and provide for a variety of embodiments of the invention. An embodiment of one method involves depositing a carbide forming metal and then thermally diffusing and annealing the metal into the diamond to form metal carbides. An embodiment of another method involves implanting one or more carbide forming metal ions into the diamond and then vacuum annealing to form the metal carbides. An embodiment of another method is to use a metal carbide target and sputter the metal carbide onto the diamond substrate, such as with a physical vapor deposition (PVD) system. An embodiment of another method would be to use a chemical vapor deposition (CVD) system to form the metal carbides directly from vapor chemical precursors, which could then form metal carbides and be deposited onto the diamond wafer. It is also anticipated that various different embodiments of these combinations of methods could be applied to different sides of the diamond substrate that would produce a metal carbide layer with specific properties that reflect the demands placed on that specific part of the anode structure.

For example, in one embodiment, in order to keep the thermal resistance low from the radiation producing layer 105 to the diamond substrate 101, it may be desirable to form a very thin carbide layer on the target side of the diamond substrate. In one embodiment, this could be achieved by implanting metal ions into the target side of the diamond substrate to produce an optimized carbide concentration profile, which minimizes thickness while still resisting delamination. In an embodiment, the backside carbide layer 110 can be formed by a cheaper metal deposition and diffusion anneal, even if it produces a thicker carbide layer. A thicker backside carbide layer 110 may not be a serious impediment to heat flow because in one embodiment, the diamond substrate 101 covers a much bigger area than the area of the radiation producing layer 105 being subjected to energetic bombardment. This creates a hot spot, which must go through the target side carbide layer 102 to the diamond substrate 101, which allows the heat to spread out and dissipate. Since the diamond substrate 101 has a large area for heat transfer, then the effect of a higher thermal resistance, due to the thicker backside carbide layer 110, is offset by the larger area of the diamond substrate 101 for heat transfer.

An embodiment may include a sputtered deposition of one or more metal carbides on the target side, so as to maintain a tight control on the composition of the target metal carbide layer 102. Such controls may be necessary to keep the target side carbide layer 102 thin and inhibit delamination in a hostile environment of heat and energetic particle bombardment. In an embodiment, the demands on the backside carbide layer 110 may be less demanding and could be formed by a cheaper CVD process, or in another embodiment, a cheaper metal diffusion process.

FIGS. 2B to 2E illustrate an embodiment of the method of making an anode for generating radiation. This embodiment of the invention comprising the steps of obtaining a diamond substrate 201, having a high thermal conductivity, and having a target side 208 and a backside 209, opposite the target side 208; then cleaning the diamond substrate 201, and in one embodiment, with a Sarnoff spec 401 clean; then degassing the substrate by heating, and in one embodiment, under vacuum, to a temperature between about 100° C. and about 200° C.; then sputter cleaning the backside 209 of the diamond substrate 201 for about 2 minutes to about 30 minutes, and in one embodiment, for about 10 minutes, at a power level of about 100 watts to about 700 watts, and in one embodiment, at about 250 watts; and then depositing one or more carbide forming materials into one or more back side carbide forming layers on the backside of the diamond substrate 101. In one embodiment, the one or more back side carbide forming layers comprise an initial backside layer 211, wherein the initial backside layer 211 may be selected from a group consisting of chromium, nickel, titanium, iron, silicon, germanium, gold, boron, iridium, lanthanum, lithium, manganese, molybdenum, osmium, rhenium, rhodium, ruthenium, thorium, uranium, vanadium, tungsten, or any combination thereof. In one embodiment, chromium is used.

In some embodiments, the thickness of the initial backside layer is sufficient to provide enough carbide-forming material to form the backside metal carbide layer 210. In one embodiment, it may be desirable to retain part of the initial backside layer to help provide sufficient structural support to the heat sink 215 to inhibit delamination. In another embodiment, the entire initial backside layer is formed into the backside carbide layer 210. In other embodiments, which comprise depositing one or more additional backside layers onto the initial backside layer 211 before forming the backside carbide layer 210, it may be desirable for the initial backside layer 211 to be entirely consumed by the backside metal carbide layer 210, and in some embodiments, all or part of the second and/or third backside layers 212, 213 could also be formed into part of the backside carbide layer 210.

In an embodiment, the initial backside layer 211, whether by itself or in combination with other backside layers, should not to be so thick as to substantially raise the thermal resistance between the diamond substrate 201 and the heat sink 215, and thus result in a substantial reduction in heat flow. In an embodiment, the thickness of the initial backside layer 211 is less than about 1 microns. In an embodiment, the thickness of the initial backside layer 211 is between about 20 nm. to about 200 nm. In one embodiment, the thickness of the initial backside layer 211 is about 50 nm.

Figure 2B:
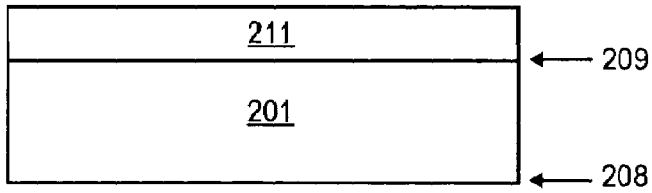
Figure 2C:
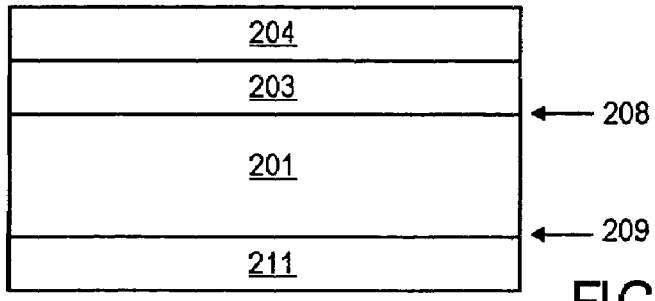

Subsequent to the process steps of FIG. 2B, the diamond substrate structure is flipped, so that the target side 208 of the diamond substrate 201 is facing up, as indicated in FIG. 2C. In an embodiment, the process further comprises the following steps; degassing the substrate by heating, and in one embodiment, under vacuum, to between about 100° C. and about 200° C.; then sputter cleaning the target side 208 of the diamond substrate 201 for about 2 minutes to about 30 minutes, and in one embodiment, for about 10 minutes, at a power level of about 100 watts to about 700 watts, and in one embodiment, at about 250 watts; and then depositing one or more carbide forming materials into one or more target side carbide forming layers, which are identified as, initial buffer layers 203, 204 on the target side 208 of the diamond substrate 201.

In one embodiment, the one or more initial buffer layers comprise an initial buffer layer 203 and a second buffer layer 204, comprising one or more carbide forming materials, wherein the one or more carbide forming materials are selected from a group consisting of chromium, titanium, iron, silicon, germanium, gold, boron, iridium, lanthanum, lithium, manganese, molybdenum, osmium, rhenium, rhodium, ruthenium, thorium, uranium, vanadium, tungsten, or any combination thereof. In one embodiment, titanium and then chromium comprise the initial buffer layer 203 and the second buffer layer 204, respectively. In some embodiments, the initial buffer layer 203 is omitted, in other embodiments the second initial buffer layer 204 is omitted. In another embodiment, a third or fourth initial buffer layer may also be formed.

In some embodiments, the thickness of the initial buffer layer 203 is sufficient to provide enough carbide-forming material to form the target side metal carbide layer 202. In an embodiment, it may be desirable to retain part of the initial buffer layer 203 to help provide sufficient structural support to the radiation producing layer 205 to inhibit delamination. In another embodiment, the entire initial buffer layer 203 is formed into the target side carbide layer 202. In one embodiment, the initial buffer layer 203 is omitted, and the second initial buffer layer 204 is formed directly on the diamond substrate 201. In this configuration, the second initial buffer layer 204 is all or partially consumed into the target side carbide layer 202. In other embodiments, which comprise depositing one or more additional initial buffer layers onto the initial buffer layer 203 before forming the target side carbide layer 202, it may be desirable for the initial backside layer 211 to be entirely consumed by the target side metal carbide layer 202, and in some embodiments, all or part of the second initial buffer layers 204 could also be formed into part of the target side carbide layer 202. In an embodiment, the initial buffer layers 203, 204 are annealed, and the target side carbide layer 202 formed before the deposition of the radiation producing layer 205. Damage to the radiation producing layer 205 may occur if the layer were subjected to the anneal used to form carbides. The radiation producing layer 205 may become oxidized, damaging its surface.

In an embodiment, it is desirable for the total combination of one or more initial buffer layers 203, 204, not to be so thick as to substantially raise the thermal resistance between the diamond substrate 201 and the radiation producing layer 205, and result in a substantial reduction in heat flow. In one embodiment, the thickness of the initial buffer layer 203 is less than about 100 nm. In another embodiment, the thickness of the initial buffer layer 203 is less than about 40 nm. In an embodiment, the thickness of the second initial buffer layer 204 may be less than about 500 nm. In another embodiment, the second initial buffer layer 204 may be between about 50 nm. and about 150 nm. In an embodiment, the total combined thicknesses of one or more initial buffer layers 203, 204, may be less than about 1 micron. In another embodiment, the total combined thicknesses of one or more initial buffer layers 203, 204, may be between about 50 nm. and about 200 nm.

Figure 2D:
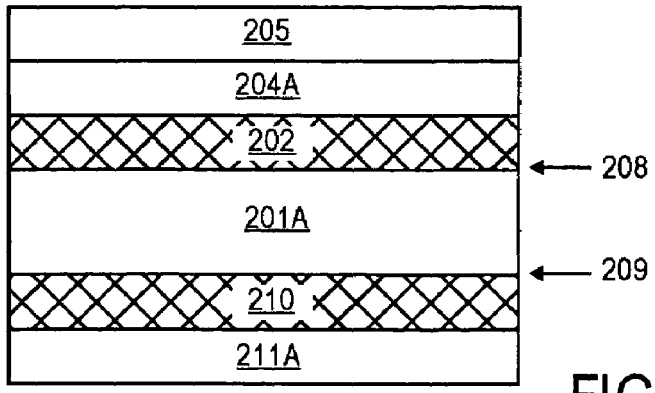

In an embodiment, subsequent to the process steps of FIG. 2C, the diamond substrate structure is vacuum annealed to form both a target side carbide layer 202 and a backside carbide layer 210, as indicated in FIG. 2D. In an embodiment, the vacuum anneal is performed under vacuum, at a temperature between about 300° C. and about 600° C., for a duration between about 2 minutes and about 60 minutes. In one embodiment, the vacuum anneal is performed at a temperature of about 400° C. and for a duration of about 20 minutes. Another embodiment, provides an alternative to the thermal furnace vacuum anneal, by using a laser anneal, and in one embodiment, under vacuum, to form the metal carbide layers. In some embodiments, an anneal in vacuum may be desirable to prevent the oxidation of carbon atoms in the carbides or in the diamond substrate. In some embodiments, a laser anneal may be desirable in cases were the metal carbides being formed on the target side and the backside are substantially different and one carbide requires substantially higher temperatures for carbide formation, than the other side. A laser anneal could generate the higher temperatures on one side without subjugating the other side to the same high temperatures, which could be detrimental to the anode.

In those embodiments were the carbide layers are formed by implanting metal ions, or by a CVD, or by a PVD, or sputtering process, a similar vacuum anneal would be desirable. It is anticipated that the optimum anneal temperatures and durations would be different for each process and such a determination would be within the skills of an ordinary practitioner.

Referring to FIG. 2D, an embodiment of the vacuum anneal process has resulted in the formation of a target side carbide layer 202, and a backside carbide layer 210, simultaneously, while consuming all or part of the initial buffer layer 203, and in one embodiment, part of the initial second buffer layer 204, on the target side 208, and in one embodiment, all or part of the initial backside layer 211, on the backside 209. In an embodiment, after the anneal, a second buffer layer 204*a* and a first backside layer 211*a* remain on both the target side carbide layer 202 and the backside carbide layer 210, respectively.

In an embodiment, subsequent to the anneal and the formation of the carbide layers, the steps of degassing and sputter cleaning the anode are preformed prior to the deposition of the x-ray producing layer 205 over the target side carbide layer 202. In an embodiment, the step of degassing the substrate is performed by heating, and in one embodiment, under vacuum, to between about 100° C. and about 200° C.; and then sputter cleaning the top surface of the target side of the anode structure, which in one embodiment, may be the target side metal carbide layer 202, and in another embodiment, it may be the target side second buffer layer 204*a*, for about 2 minutes to about 30 minutes, and in one embodiment, for about 10 minutes, at a power level of about 100 watts to about 700 watts, and in one embodiment, at about 250 watts.

In an embodiment, subsequent to the steps of degassing and sputter cleaning, the x-ray producing layer 205 is formed on the top surface of the target side of the anode structure, which in one embodiment, may be the target side metal carbide layer 202, and in another embodiment, it may be the target side second buffer layer 204*a*. In an embodiment, the x-ray producing layer 205 may be selected from the group consisting of aluminum, magnesium, tungsten, and any combination thereof. In various embodiments, other materials, that generate a desired radiation spectrum for various other anode applications, could equivalently be used for the radiation producing layer 205.

In an embodiment, the radiation producing layer 205 is thick enough to stop the energetic particles impinging the radiation producing layer 205, but not so thick as to unduly raise the thermal resistance to the diamond substrate 201*a*, and thus significantly reducing heat flow away from the heated sections of the radiation producing layer 205. In some embodiments, the thickness of the radiation producing layer is between about 1.0 micron and about 10.0 microns. In one embodiment, the thickness is between about 2.0 microns and about 5.0 microns.

In another embodiment, the x-ray producing layer 205 further comprises a surface smoothing material. The surface smoothing material comprises copper, or tungsten, or titanium, or nickel, or gold, or chromium, or any combination thereof. In one embodiment, the surface smoothing material comprises copper and the x-ray producing layer 205 comprises aluminum. It is believed by way of example, in one embodiment, the surface smoothing material [Cu] resides in the grain boundaries of the [Al] grains, thus helping to strengthen and bind the [Al] grains together, thus improving the resistance of the x-ray producing layer 205 against energetic bombardments. Resistance to electron and/or ionic bombardment of the x-ray producing layer 205 helps reduce surface roughness. A rough surface reabsorbs the x-rays produced, and thus, reduces the intensity of the useable x-rays generated by the anode.

In an embodiment, the concentration of the surface smoothing material is high enough to inhibit surface roughening, but not so high as to unduly reduce the intensity of the desired x-ray signal. In one embodiment, the concentration of the surface smoothing material may not be so high as to unduly increase undesirable emissions that significantly interfere with the performance of the equipment using the anode. Undesirable emissions can stem from the spectral emissions generated by the smoothing material itself, or from secondary emissions resulting from stray or scattered emissions unintentionally interacting with the instrument's components. In an embodiment, the concentration of the surface smoothing material is between about 10 wt. % and about 0.01 wt. %.

In one embodiment, the concentration of the surface smoothing material is between about 1.0 wt. % and about 0.2 wt. %.

In various embodiments, the step of forming the radiation producing layer 205 can be performed by a vacuum sputtering process, such as by PVD, or a by chemical vapor deposition (CVD), or any combination thereof. In other embodiments, these processes can also be supplemented by any combination of high and low energy ion implants. In various embodiments, part or all of the surface smoothing material can be implanted or diffused into the radiation producing layer 205, to provide a desired dopant profile.

In an embodiment, the radiation producing layer 105, may be formed by sputtering a target material containing the desired concentration of smoothing dopant already in the desired type of radiation producing material. For example, in one embodiment, the target material may be aluminum with 0.5% copper, sputtered onto the anode structure, to form the x-ray producing layer 205. This approach provides a uniform concentration of smoothing material in the ionizing radiation producing layer, which is controlled by the target materials.

In an embodiment, the radiation producing layer 105, may be formed by co-sputtering two or more targets, with different materials. Each target can contain a different concentration of smoothing dopant material in combination with a different concentration of radiation producing material. For example, in one embodiment, one target material may be aluminum with no copper, and the other target material may be copper with no aluminum, or in another embodiment, a copper rich target having a known concentration of copper in an aluminum base. In an embodiment, both target materials may be sputtered simultaneously onto the anode structure, to form the x-ray producing layer 205. These embodiments provide the ability to control the concentration of smoothing material at different depths in the ionizing radiation producing layer 205, by controlling the amount of target material sputtered from each target.

In an embodiment, it may be advantageous to perform a combination of both a CVD process and a PVD process. A CVD process is generally capable of forming a thicker layer quickly, while a PVD process generally provides better control of materials and contaminants. In one embodiment, processes are alternated to produce different layers having characteristics best suited for the demands placed on that particular layer. For example, in one embodiment, the radiation producing layer 205 may be formed by first sputtering a thin interface layer, then depositing a thick CVD layer, then sputtering the top surface layer. The sputtered layers may provide improved adhesion characteristics and with a tough and smooth surface finish.

In an embodiment, is may be desirable to include an ion implant process to provide a higher smoothing dopant concentration at a desired depth in the radiation producing layer 205. In one embodiment, it may be desirable to provide more smoothing dopant at the average depth of penetration of the energetic particles, where the greatest damage might occur. An embodiment may include a deposition of the dopant onto the surface and then a thermal diffusion of the smoothing dopant into the radiation producing layer 205. The thermal diffusion process may provide a higher concentration of smoothing dopant at the surface of the radiation producing layer 205, thus surface resistance to surface roughening may improve.

Figure 2E:
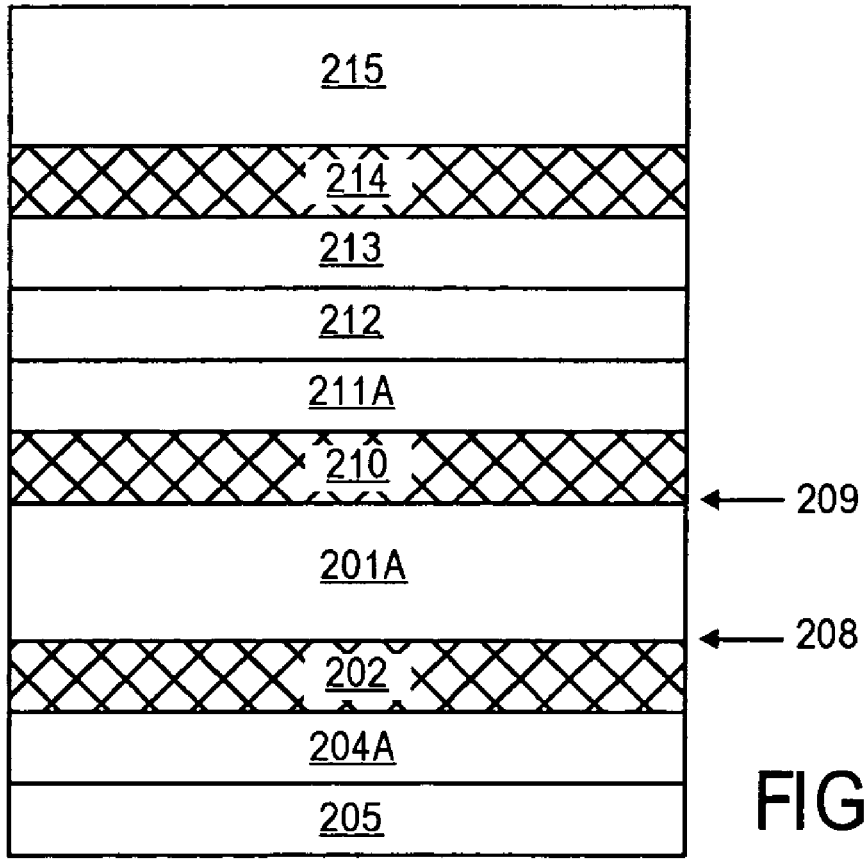

FIG. 2E indicates an embodiment of further processing of the structure formed in FIG. 2D, where the structure in FIG. 2D has been flipped so that the backside 209 of the diamond substrate 201*a* is above the target side 208. The exposed top layer after the anneal in FIG. 2D and after the structure was flipped, would constitute, in this embodiment, a backside layer 211*a*, which would be the remaining part of the initial backside layer 211 not consumed into the backside metal carbide layer 210. Another embodiment, may have the entire layer of the initial backside layer 211 consumed into the backside carbide layer 210, thus the exposed top layer would be the backside carbide layer 210.

In an embodiment, the exposed top surface layer 211*a* or 210, are then degassed by heating the diamond substrate to between about 100° C. and about 200° C., while under vacuum. Following the degassing step the top surface may be sputter cleaned, under vacuum, for a duration between about 2 min. to about 30 min., at a power level between 100 Watts and 700 Watts. Both the degassing and sputter cleaning steps are performed under vacuum and at a low enough temperature to inhibit oxidation of the x-ray producing layer 205.

In an embodiment, the steps of depositing one or more backside conductive layers 212, 213 to the backside carbide forming layers are performed subsequent to the degassing and sputter cleaning steps. In one embodiment, the backside carbide forming layer is the backside layer 211*a*. In another embodiment, where the initial backside layer 211 was completely consumed into the backside carbide layer 210, the backside carbide forming layer is the backside metal carbide layer 210.

In an embodiment, the deposition of the second and third backside layers 212, 213, are performed with a sputter deposition process, such as a PVD. Other embodiments, may include a chemical vapor deposition (CVD), or any combination of CVD and PVD type processes. In one embodiment, the one or more backside layers 212, and 213 are selected from the group consisting of titanium, chromium, nickel, gold, silver, aluminum, copper, any alloy thereof, and any combination thereof. In an embodiment, the one or more backside layers 212, and 213 comprise any combination of materials and layers having a high thermal conductivity and where each layer possesses the material properties to bond well with both its adjacent layers. Such an anode results in a progression of well bonding, compatible materials starting from the backside carbide layer 210 and ending in the heat sink 215.

In an embodiment, the thicknesses of the second and third backside layers 212, 213 need to be thick enough to provide sufficient structural support between the anode's diamond substrate structure, and the heat sink 215. Excessive thicknesses of the second and third backside layers 212, 213 may increase the thermal resistance to the heat sink enough to significantly reduce heat removal from the ionizing radiation producing layer 205 during operation of the instrument. One embodiment comprises a second backside layer 212, comprising nickel, which is deposited onto the first backside chromium layer 211*a*. In one embodiment, the second backside layer has a thickness between about 2 microns and about 50 nm., and in another embodiment about 500 nm. In an embodiment, a third backside layer 213, comprising gold, is deposited onto the second backside nickel layer 212. In an embodiment, the third backside layer has a thickness of less than about 1 micron, and in one embodiment about 100 nm.

Figure 2F:
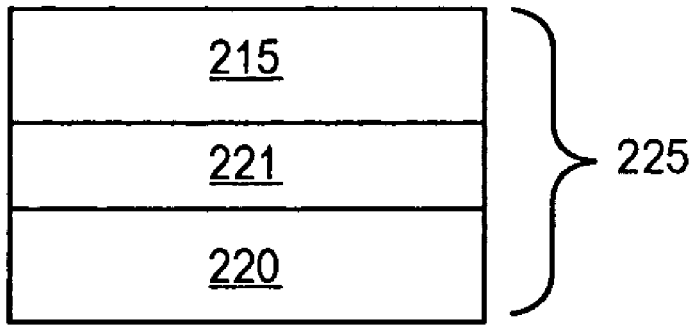

The embodiments disclosed in FIG. 2E include the attachment of a heat sink 215 to the backside 209 of the diamond substrate structure. In one embodiment, the means of attaching the heat sink 215 comprises bonding the one or more backside conductive layers to the heat sink 215 by means of a solder layer 214. Embodiments disclosed in FIG. 2F, comprises placing a solder foil 221 in contact with and between a heat spreader structure 220 and the heat sink 215, to form a solder sandwich 225. Then the solder sandwich 225, comprising the heat sink 215, the solder foil 214, and heat spreader structure 225 to soldering temperatures, either in vacuum or in a foaming gas environment, so as not to oxidize the target side surface of the heat spreader structure 225. In some embodiments, the heat sink 215 comprises skeleton cemented diamond (ScD), or Cu, or BeO, or Al, or W, or SiC, or AlN, or any combination thereof. In an embodiment, the heat spreader structure 225 comprises diamond. In some embodiments, the heat spreader structure 220 comprises diamond and one or more materials selected from the group consisting of skeleton cemented diamond (ScD), Cu, BeO, Al, W, SiC, AlN, one or more metal carbide layers, one or more metal carbide forming metals, one or more metal layers, one or more buffer layers, one or more radiating forming layers, or any combination thereof. In an embodiment, the heat sink 215 comprising one or more materials having a thermal conductivity greater than about 500 W/mK. In an embodiment, the skeleton cemented diamond comprises diamond grains within a binding matrix of one or more hard ceramics having very high melting points. In an embodiment, the binding matrix comprises silicon carbide. In an embodiment, the diamond grains range in size from about 5 microns to about 250 microns. In an embodiment, the diamond grains range in size from about 100 microns to about 250 microns. In an embodiment, the diamond grains comprise about 30 to 70 volume percent of the skeleton cemented diamond.

Embodiments disclosed in FIG. 2E, involves depositing a solder layer 214, on the backside layers 213 and/or on the heat sink 215. Then placing the two structures together, having the solder layer interposed between the heat sink 215 and the backside layers 213 of the substrate structure. Then heating both structures to soldering temperatures, either in a vacuum or in a foaming environment, and then cooling to below soldering temperatures, while both structures are still in contact with each other.

In some embodiments, the solder layer 214 and the solder foil 221 comprise a low melting point temperature soldering material that when heated to soldering temperatures would not cause undue oxidation of the ionizing radiation forming layer 205. In one embodiment, the low melting point temperature soldering material has a working soldering temperature of less than or about 280° C. In an embodiment, the soldering material is selected from the group consisting of an alloy of gold and tin, an alloy of silver and tin, an alloy of lead and tin, an alloy of silver and lead, and any combination thereof. In one embodiment, the soldering material is composed of an alloy of gold and tin, and in another embodiment, contains approximately 10% to 30% tin and approximately 90% to 70% gold. In an embodiment, the soldering material comprises an alloy having concentrations approximately corresponding to a eutectic melting point. In an embodiment, an alloy of approximately 80% gold and approximately 20% tin concentrations corresponds approximately to the eutectic melting point of a gold/tin alloy.

Figure 2G:
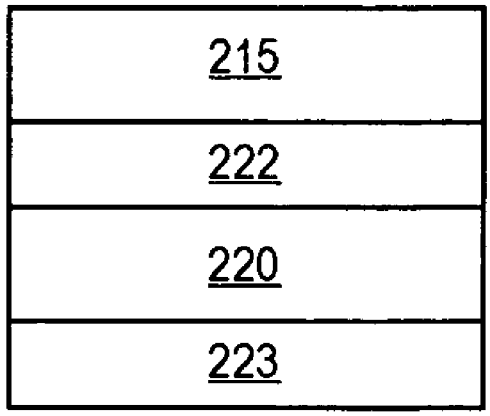

In an embodiment, the heat sink 115 comprises a skeleton cemented diamond material, so as to provide a tough highly conductive heat sink having a high melting point. In an embodiment, the skeleton cemented diamond material comprises a metal carbide skeleton cement mixed with diamond powder, diamond dust, diamond fragments, or any combination thereof. In an embodiment, the metal carbide comprises silicon carbide. Embodiments disclosed in FIG. 2G, include a bonding material layer 222 formed between the heat spreader structure 220 and the heat sink 215. In one embodiment, the bonding material layer 222 comprises a metal carbide layer interposed between the heat spreader structure 220 and the heat sink 215.

In an embodiment, the heat sink 115 and the heat spreader structure 220, which comprises the diamond substrate 101 and may contain one or more target side and/or back side layers, are bonded together by a high temperature reactive brazing process. In an embodiment, the high temperature reactive brazing process, may comprise providing a carbide forming material between the heat sink 115 and the diamond substrate structure; then heating, at carbide forming temperatures. The heat sink 115 and the heat spreader structure, with the carbide forming material there between, forms a bonding material layer 222, comprising a carbide layer. In an embodiment, the heat spreader structure 220 comprises one or more metal carbide forming layers on the target side of the diamond substrate structure prior to heating at carbide forming temperatures. Thus heating at carbide forming temperatures result in forming a target side carbide layer 223, which comprises a metal carbide layer on the target side of the diamond substrate structure, while also forming a bonding material layer 222, comprising a metal carbide layer between the heat sink 115 and the heat spreader structure 220. In one embodiment, the heat sink 115 is comprised of a skeleton cemented diamond, comprising a metal carbide binder. In another embodiment, the radiation producing layer 105 is formed after the heating, at carbide forming temperatures, so as not to damage the radiation producing layer 105, during the heating, at carbide forming temperatures.

Figure 3A:
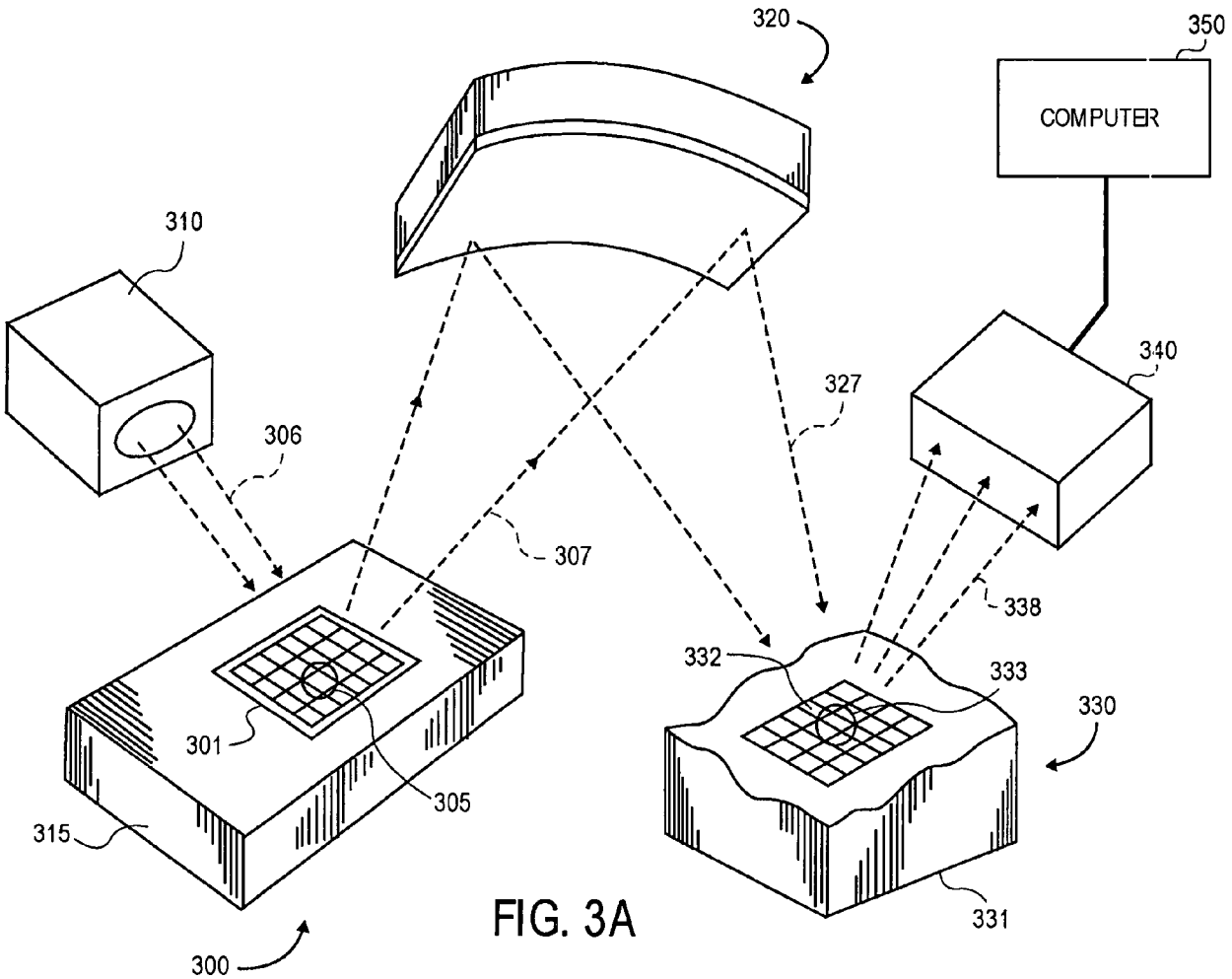
FIG. 3A illustrates a view of an embodiment of using the anode in an instrument.

FIG. 3A discloses an embodiment of an instrument using the anode 300 of this invention, including all the embodiments of the anode 300 disclosed. One embodiment of such an instrument is its use in x-ray photoelectron spectroscopy (XPS). In this embodiment, an energetic particle beam 306 is produced from an energetic particle source 310, which impinges upon the surface of the anode 300, specifically the ionizing radiation producing layer 305. The energetic particle beam 306 can comprise electrons, or ions, or neutral particle, or photons, or any combination thereof, having enough energy to ionize atoms, and thus produce ionizing radiation 307. The ionizing radiation 307 can comprise ultra-violet radiation, or x-rays, or gamma rays, or any combination thereof. One effect of the transformation of the energetic particle beam 306, such as electrons, to an ionizing radiation 307, such as x-rays, is the production of a substantive amount of heat, particularly in large beam currents and/or high energy applications. The effect of such heat generation can result in melting and/or delaminating the ionizing radiation producing layer 305, and thus damage the anode.

In an embodiment, the ionizing radiation 307, such as x-rays, are processed and used in an instrument. In an embodiment, the ionizing radiation 307 is reflected and focused by a Bragg crystal monochromator 320. In an embodiment, the reflected ionizing radiation 327 then impinges upon the sample 332 placed onto the sample holder 331, and more specifically onto the targeted sample surface 333 to be examined. In an embodiment, the reflected ionizing radiation 327, such as x-rays, produce photoelectrons 338, which can be specifically identified with particular chemical elements, thus permitting a surface analysis of the targeted sample surface 333. In one embodiment, a photoelectron detector 340 detects the photoelectrons 338. In one embodiment, the data generated by the photoelectron detector is communicated to a computer 350 for further processing to generate useful information and/or images.

In other embodiments, the anode may be used in any other types of instruments and equipment using x-ray sources. One embodiment, may use the anode for generating x-rays for x-ray lithography equipment. In another embodiment, the anode could be used to generate x-rays for a scanning electron microscope (SEM).

Figure 3B:
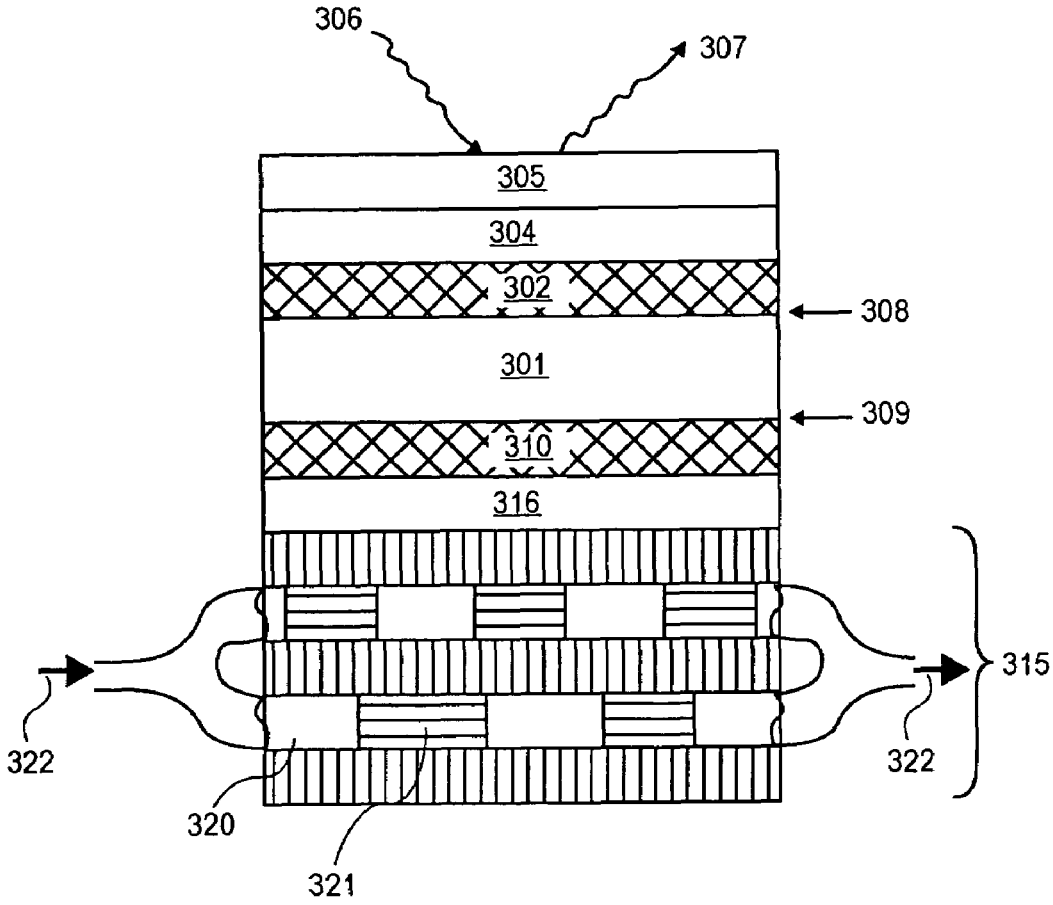
FIG. 3B illustrates a cross-sectional view of the method of using the basic elements of an embodiment of the anode.

Referring to FIG. 3B, one embodiment of a method of using the anode 300 for generating ionizing radiation 307 comprising the step of irradiating with energetic particles 306 the surface of an ionizing radiation producing layer 305 formed over a carbide layer 302 on the target side 308 of a diamond substrate 301 so as to produce ionizing radiation 307 from said surface of the ionizing radiation producing layer 305. The carbide layer 302 bonds the ionizing radiation producing layer 305 to the diamond substrate 301. The diamond substrate 301 has a high thermal conductivity and removes heat from the surface of the ionizing radiation producing layer 305 to the heat sink 315 attached to the backside 309 of the diamond substrate 301.

In an embodiment, the cooling of the heat sink 315 is performed by passing coolant 322 through channels 320 formed within the heat sink 315. In one embodiment, the removal of heat from the heat sink 315 by the coolant 322 is further increased by the use of a conductive foam 321 placed in the channels 320 of said heat sink 315.

In some embodiments, the instrument impinges energetic particles 306 upon the anode 300 to generate an emission of ionizing radiation 307, then processing said ionizing radiation 307 for use in an instrument, which is then focused onto a specimen 332. In an embodiment, the surface of the ionizing radiation producing layer 305 is maintained smoother by use of a surface smoothing dopant in the ionizing radiation producing layer 305. A smoother surface of the radiation producing layer 305 facilitates a more efficient processing of the ionizing radiation 307, thus increasing both the yield and quality of the ionizing radiation 307 produced.

While certain exemplary embodiments have been described and shown in the accompanying drawings, it is to be understood that such embodiments are merely illustrative and not restrictive of the current invention, and that this invention is not restricted to the specific constructions and arrangements shown and described since modifications may occur to those ordinarily skilled in the art.

What is claimed is:

1. An anode for generating ionizing radiation comprising:

a diamond substrate, having a target side and a backside, and having a thermal conductivity higher than aluminum;

a metal carbide layer on the target side of the diamond substrate; and an ionizing radiation producing layer over the metal carbide layer.

2. The anode as claimed in claim 1, wherein the metal carbide layer is thick enough to inhibit delamination of the ionizing radiation producing layer, but not so thick as to unduly increase the thermal resistance to the diamond substrate, wherein said unduly increase in thermal resistance would result in a large enough build up of heat to raise the temperature of the radiation producing layer to cause the radiation producing layer to melt, vaporize, and/or delaminate.

3. The anode as claimed in claim 1, further comprising a buffer layer between the metal carbide layer and the ionizing radiation producing layer;

wherein the buffer layer comprises a metal carbide forming material.

4. The anode as claimed in claim 1, wherein the ionizing radiation producing layer is selected from the group consisting of aluminum, magnesium, tungsten, and any combination thereof.

5. The anode as claimed in claim 1, wherein the metal carbide layer is selected from the group consisting of chromium carbide, titanium carbide, iron carbide, silicon carbide, germanium carbide, gold carbide, boron carbide, iridium carbide, lanthanum carbide, lithium carbide, manganese carbide, molybdenum carbide, osmium carbide, rhenium carbide, rhodium carbide, ruthenium carbide, thorium carbide, uranium carbide, vanadium carbide, tungsten carbide, and any combination thereof.

6. The anode as claimed in claim 5, wherein the thickness of the metal carbide layer is between about 2 nm. and about 200 nm.

7. The anode as claimed in claim 1, wherein the ionizing radiation producing layer further comprises a surface smoothing dopant.

8. The anode as claimed in claim 7, wherein the surface smoothing dopant is selected from the group consisting of copper, tungsten, titanium, nickel, gold, and chromium.

9. The anode as claimed in claim 7, wherein the concentration of the surface smoothing dopant is sufficiently high enough to inhibit surface roughening, without substantially reducing the intensity of the ionizing radiation emitted from the anode when irradiated with energized electrons.

10. The anode as claimed in claim 7, wherein the concentration of the surface smoothing dopant is between about 10 wt. % and about 0.01 wt. %.

11. The anode as claimed in claim 1, further comprising a heat sink bonded to the backside of the diamond substrate.

12. The anode as claimed in claim 11, wherein the means for bonding further comprises:

a backside metal carbide layer on the backside of the diamond substrate; and one or more backside layers between the backside metal carbide layer and the heat sink;

wherein, the backside metal carbide layer bonds to the diamond substrate and to the backside layer, which is attached to the heat sink.

13. The anode as claimed in claim 12, wherein the one or more backside layers are selected from the group consisting of titanium, chromium, nickel, gold, silver, aluminum, copper, any alloy thereof, and any combination thereof.

14. The anode as claimed in claim 12, wherein the means for bonding further comprises a solder layer between the backside layers and heat sink;

wherein the solder layer comprises a low melting temperature material that when heated to soldering temperatures would not cause undue oxidation of the ionizing radiation forming layer.

15. The anode as claimed in claim 14, wherein the low melting temperature material has a working soldering temperature of less than or about 280° C.

16. The anode as claimed in claim 14, wherein the solder layer is selected from the group consisting of an alloy of gold and tin, an alloy of silver and tin, an alloy of lead and tin, an alloy of silver and lead, and any combination thereof.

17. The anode as claimed in claim 16, wherein the solder layer is compose of an alloy of gold and tin, containing approximately 10% to 30% tin and approximately 90% to 70% gold.

18. The anode as claimed in claim 12, wherein the backside layers comprise:

a backside chromium layer attached to the backside carbide layer;

a backside nickel layer attached to the backside chromium layer; and a backside gold layer attached to the backside nickel layer.

19. The anode as claimed in claim 11, wherein the heat sink comprises a high thermal conductivity material;

wherein the high thermal conductivity material is selected from the group consisting of skeleton cemented diamond (ScD), BeO, tungsten, silicon carbide, aluminum nitride, copper, aluminum, silver, and any combination thereof;

wherein the skeleton cemented diamond comprises diamond grains within a binding matrix of one or more hard ceramics having very high melting points.

20. The anode as claimed in claim 19, wherein the heat sink comprises one or more channels within the body of the heat sink, in which cooling fluids can flow through the channels and remove heat from the heat sink.

21. The anode as claimed in claim 20, wherein the channels further comprise a conductive foam within the channels to further increase the total effective surface area of the channels without significantly reducing the flow rate of the cooling fluid.

22. A method of making an anode for generating radiation comprising the steps of:

obtaining a diamond substrate, having a high conductivity, and having a target side and a backside;

forming a metal carbide layer on the target side of the diamond substrate; and forming a radiation producing layer over the metal carbide layer.

23. The method of making an anode as claimed in claim 22, further comprising the step of forming an initial buffer layer on the target side of the diamond substrate;

wherein the step of forming the initial buffer layer occurs before the formation of the radiation producing layer; and wherein the initial buffer layer comprises a carbide forming material.

24. The method of making an anode as claimed in claim 23, wherein the initial buffer layer thickness is less than about 100 nm.

25. The method of making an anode as claimed in claim 23, further comprising the step of a carbide anneal after the formation of the buffer layer and before the formation of the x-ray producing layer;

wherein the carbide anneal step produces a metal carbide layer on the diamond substrate;

wherein the initial buffer layer is consumed by the formation of the metal carbide layer.

26. The method of making an anode as claimed in claim 25, wherein the anneal comprises a vacuum anneal;

wherein the vacuum anneal is performed under vacuum, at a temperature between about 300° C. and about 600° C.

27. The method of making an anode as claimed in claim 25, wherein the vacuum anneal comprises a laser anneal.

28. The method of making an anode as claimed in claim 22, wherein the step of forming the carbide layer, further comprise the steps of:

performing a wafer surface clean; and depositing the metal carbide layer by means of a chemical vapor deposition (CVD).

29. The method of making an anode as claimed in claim 28, wherein the step of performing a wafer surface clean, further comprise the steps of:

degassing the substrate by heating the substrate to between about 100° C. and about 200° C.; and sputter cleaning for a duration of between about 2 min. to about 30 min., at a power level between 100 Watts and 700 Watts.

30. The method of making an anode as claimed in claim 22, wherein the step of forming the carbide layer further comprise the steps of:

implanting one or more carbide forming materials into the target side of the diamond wafer; and vacuum annealing the diamond substrate to form the carbide layer.

31. The method of making an anode as claimed in claim 22, further comprising the step of bonding a heat sink to the backside of the diamond substrate;

wherein the means of bonding the heat sink comprises;

forming a backside layer attached to the backside of the diamond substrate;

annealing to form a backside carbide layer on the backside of the diamond substrate.

32. The method of making an anode as claimed in claim 31, further comprising the formation of one or more backside layers over the backside carbide layer, wherein the means for attaching further comprises bonding the heat sink to the one or more backside layers by forming a solder layer.

33. The method of making an anode as claimed in claim 32, wherein forming of the solder layer comprises placing a foil of solder between the heat sink and the diamond substrate structure, thus forming a solder sandwich; and further comprising:

heating the solder sandwich, to soldering temperatures; and preventing the oxidation of the target side surface of the structure, by heating either under vacuum or in a forming gas environment.

34. The method of making an anode as claimed in claim 32, wherein forming of the solder layer comprises depositing a solder layer on the backside layers and/or on the heat sink; and further comprising:

placing the heat sink and the backside layers together, having the solder layer interposed in between, thus forming a solder sandwich;

heating the solder sandwich, to soldering temperatures, either in a vacuum or in a foaming environment; and cooling the solder sandwich to below soldering temperatures, while the heat sink and the back side layers are still in contact with each other.

35. The method of making an anode as claimed in claim 32, wherein the solder layer comprising an alloy having concentrations approximately corresponding to a eutectic melting point.

36. The method of making an anode as claimed in claim 35, wherein the alloy having concentrations approximately corresponding to a eutectic melting point comprises an alloy of approximately 80% gold and approximately 20% tin.

37. The method of making an anode as claimed in claim 22, further comprising the steps of:

cleaning the diamond substrate;

degassing the substrate by heating the diamond substrate to between about 100° C. and about 200° C.;

sputter cleaning the diamond substrate;

depositing one or more carbide forming materials into one or more bark side carbide forming layers on the backside of the diamond substrate;

degassing the substrate by heating the diamond substrate to between about 100° C. and about 200° C.;

sputter cleaning the substrate;

depositing one or more carbide forming materials into one or more target side carbide forming layers on the target side of the diamond substrate;

vacuum annealing the diamond substrate to form both a target side carbide layer and a backside carbide layer;

wherein the vacuum anneal is performed under vacuum, at a temperature between about 300° C. and about 600° C.;

degassing the substrate by heating the diamond substrate to between about 100° C. and about 200° C.;

sputter cleaning the substrate;

depositing the x-ray producing layer over the target side carbide layer;

wherein the x-ray producing layer is selected from the group consisting of aluminum, magnesium, and any combination thereof;

wherein the x-ray producing layer further comprises a surface smoothing material;

wherein the surface smoothing material comprises copper;

degassing the substrate by heating the substrate to between about 100° C. and about 200° C.;

sputter cleaning the substrate, under vacuum, for a duration of between about 2 min. to about 30 min., at a power level between 100 Watts and 700 Watts;

wherein both the degassing and sputter cleaning steps are under vacuum and at a low enough temperature to inhibit oxidation of the x-ray producing layer;

depositing one or more backside conductive layers to the backside carbide forming layers;

attaching a heat sink to the backside of the substrate;

wherein the means of attaching the heat sink comprises;

bonding the heat sink to the one or more backside conductive layers by means of a solder layer.

38. A method of using an anode for generating ionizing radiation comprising the step of:

irradiating with energetic particles the surface of an ionizing radiation producing layer formed over a carbide layer on the target side of a diamond substrate so as to produce ionizing radiation from said surface of the ionizing radiation producing layer, wherein the carbide layer bonds the ionizing radiation producing layer to the diamond substrate, and wherein the diamond substrate has a high thermal conductivity and removes heat from the surface of the ionizing radiation producing layer to a heat sink attached to the backside of the diamond substrate.

39. The method of using an anode as claimed in claim 38, further comprising the step of:

cooling said heat sink by passing coolant through channels formed within the heat sink.

40. The method of using an anode as claimed in claim 39, wherein the removal of heat from the heat sink by the coolant is further increased by the use of a conductive foam in the channels of said heat sink.

41. The method of using an anode as claimed in claim 38, wherein the irradiating with energetic particles comprises an electron beam; and wherein the producing of ionizing radiation comprises x-ray radiation.

42. The method of using an anode as claimed in claim 38, further comprising the step of:

processing said ionizing radiation for use in an instrument, wherein the instrument impinges energetic particles upon the anode to generate an emission of ionizing radiation onto a specimen, wherein the surface of the ionizing radiation producing layer is maintained smoother by use of a surface smoothing dopant in the ionizing radiation producing layer.

43. The method of using an anode as claimed in claim 42, wherein the instrument is used for x-ray photoelectron spectroscopy.

44. An anode for generating ionizing radiation comprising:

a diamond substrate, having a target side and a backside, and having a thermal conductivity higher than aluminum;

a metal carbide layer on the target side of the diamond substrate;

an ionizing radiation producing layer over the metal carbide layer;

a heat sink bonded to the backside of the diamond substrate; and wherein the heat sink comprises a skeleton cemented diamond material.

45. The anode as claimed in claim 44, wherein the skeleton cemented diamond material comprises a metal carbide skeleton cemented diamond material.

46. The anode as claimed in claim 45, further comprising a metal carbide layer interposed between the diamond substrate and the heat sink.

47. The anode as claimed in claim 45, wherein the metal carbide skeleton cemented diamond material comprises silicon carbide.

48. The anode as claimed in claim 45, wherein the metal carbide skeleton cemented diamond material comprises a metal carbide cement mixed with a diamond material selected from the group consisting of diamond powder, diamond dust, diamond fragments, and any combination thereof.

49. A method of making an anode for generating radiation comprising:

providing a diamond substrate, having a high conductivity, and having a target side and a backside;

providing a heat sink, having a high conductivity;

bonding together the diamond substrate and the heat sink by a high temperature reactive brazing process;

wherein the said high temperature reactive brazing process comprises:

depositing a metal carbide forming layer between the diamond substrate and the heat sink;

heating the diamond substrate, the metal carbide forming layer, and the heat sink, to metal carbide forming temperatures;

sustaining said metal carbide forming temperatures until a metal carbide layer is formed between the heat sink and the diamond substrate;

forming a metal carbide layer on the target side of the diamond substrate; and forming a radiation producing layer over the carbide layer.

50. The method of making an anode as claimed in claim 49, wherein the heat sink comprises a high thermal conductivity material;

wherein the high thermal conductivity material is selected from the group consisting of skeleton cemented diamond (ScD), BeO, tungsten, silicon carbide, aluminum nitride, copper, aluminum, silver, and any combination thereof; wherein the skeleton cemented diamond comprises diamond grains within a binding matrix of one or more hard ceramics having very high melting points.

51. The method of making an anode as claimed in claim 50, wherein the heat sink comprises skeleton cemented diamond material;

wherein the skeleton cemented diamond material comprises diamond grains within a binding matrix comprising a hard ceramic having very high melting point;

wherein, the diamond grains range in size from about 5 microns to about 250 microns; and wherein, the diamond grains comprise about 30 to 70 volume percent of the skeleton cemented diamond.

52. The method of making an anode as claimed in claim 50, further comprising:

forming a metal carbide forming layer on the target side of the diamond substrate; and wherein the heating, at carbide forming temperatures, also forms the metal carbide layer on the target side of the diamond substrate, from the metal carbide forming layer.

* * * * *